US005718526A

United States Patent [19]

Yokota

[11] Patent Number: 5,718,526

[45] Date of Patent: Feb. 17, 1998

[54] PRINTING METHOD AND PRINTER USING GAME

[75] Inventor: Yuji Yokota, Iwate-ken, Japan

[73] Assignee: Kabushiki Kaisha Sato, Japan

[21] Appl. No.: 406,499

[22] Filed: Mar. 20, 1995

[30] Foreign Application Priority Data

Mar. 22, 1994 [JP] Japan ..... 6-075417

[51] Int. Cl.[6] ..... B41J 11/00

[52] U.S. Cl. ..... 400/605; 400/625; 400/616; 271/258

[58] Field of Search ..... 400/605, 607, 400/607.2, 608.1, 608.2, 608.3, 625, 616; 271/9, 258, 259; 226/110, 109

[56] References Cited

U.S. PATENT DOCUMENTS

| | | | |
|---|---|---|---|
| 4,688,957 | 8/1987 | Prevignano | 400/605 |
| 4,789,258 | 12/1988 | Gomoll et al. | 400/608.1 |
| 4,898,488 | 2/1990 | Yokoi et al. | 400/605 |
| 5,308,175 | 5/1994 | Ito | 400/611 |
| 5,370,291 | 12/1994 | Kusmierz | 400/605 |
| 5,486,061 | 1/1996 | Kakuguchi | 400/605 |

FOREIGN PATENT DOCUMENTS

| | | |
|---|---|---|
| 56 25386 | 12/1978 | Japan . |
| 4-43793 | 9/1992 | Japan . |

*Primary Examiner*—Christopher A. Bennett

*Attorney, Agent, or Firm*—Ostrolenk, Faber, Gerb & Soffen, LLP

[57] ABSTRACT

A method and an apparatus for selecting printing either continuous paper or single sheet paper in a printer having a printing section at which each paper may be printed. Continuous paper is fed on a first path to the printing section. Sheet paper is fed on a second path to the same printing section. Upon a first detector detecting that single sheet paper is in the second path, the continuous paper is retracted back along the first path out of the printing section. Upon a second detector detecting the retraction of the continuous paper out of the printing section, the sheet paper is transported to the printing section along the second path. As a result, only one of the continuous paper or the single sheet paper is at the printing section to be printed at one time.

8 Claims, 3 Drawing Sheets

PRINTING METHOD AND PRINTER USING GAME

BACKGROUND OF THE INVENTION

1. Field of the Invention

The invention relates to a printing method and to a printer using the method, and more particularly to a printing method and printer that can use both continuous paper and single sheets.

2. Description of the Prior Art

JP-B SHO 56-25386 discloses an example of a printer that can print either continuous paper sheet or single sheets. This printer prints on continuous paper that is continuously supplied to a printing section. To print a single sheet, the transport for continuous paper is stopped and the single sheet is supplied to and is printed on the continuous paper, (that is, the single sheet is between the print head and the continuous paper) and the continuous paper still is in position at the printing section. However, a drawback is that because the single sheet is printed on top of the stationary continuous paper, a printing impression remains on the continuous paper.

An improved printer for overcoming this problem is disclosed in JP-A HEI 4-43793. In that printer, in order to prevent the printing operation taking place on the same part of the continuous paper, during printing of a single sheet, after printing each line, for example, the platen roller is rotated by a prescribed amount to transport the continuous paper. To avoid wasting paper, when printing of continuous paper is resumed, the continuous paper that had been advanced is fed backward until the leading edge portion is at the printing position.

Thus, with the printer of JP-A HEI 4-43793 no printing impression is produced on the continuous paper when a single sheet is printed. However, the presence of continuous paper at the printing section hinders the smooth transport of single sheets. With respect also to the transporting of a single sheet that is being printed, as the continuous paper and single sheet are transported together, one on top of the other, smooth transport of the single sheet is hindered by friction between the contact surfaces of the continuous paper and the single sheet. This tends to give rise to misaligned prints and creasing. Moreover, the continuous paper also becomes prone to creasing, resulting in faulty printing on the continuous paper.

Thus, neither of the printers disclosed by JP-B SHO 56-25386 and JP-A HEI 4-43793 is satisfactory with respect to its ability to print both continuous paper and single sheets.

SUMMARY OF THE INVENTION

An object of the present invention is to provide a printing method and printer using the method for printing both continuous paper and single sheets and which, moreover, do not give rise to faulty printing and/or creasing when single sheets are printed.

To achieve the above object and with reference to the drawings hereof, the present invention provides a method of printing continuous paper 15 that is loaded in a printer 10 and is supplied to a printing section 24 where it is printed. The method comprises supplying single sheet paper 36 to the printing section 24 along a different path 44 from that used for supplying the continuous paper 15. When a single-sheet paper 36 is to be printed, it is detected beforehand that a single sheet 36 is being fed to the printing section 24. Based on the detection output, continuous paper 15 is retracted from the printing section 24 before the single sheet 36 is supplied to the printing section 24.

In accordance with this invention, when a single sheet 36 is to be printed, a single sheet sensor 52 detects beforehand that the single sheet 36 is being fed to the printing section 24. Based on that detection, continuous paper 15 which is already at the printing section 24 is fed backward by first transport means comprising a platen roller 22, a first feed roller 16 and a first pinch roller 18 to thereby remove the continuous paper 15 from the printing section 24. This enables the single sheet 36 to be smoothly transported to the printing section 24 by second transport means comprising a second feed roller 46, a second pinch roller 48 and platen roller 22. In addition, as this also ensures smooth transport of the single sheet 36 during the printing, the print is free of misalignment and other such problems. Moreover, the continuous paper 15 and single sheets 36 are supplied to the printing section 24 along separate paths 30 and 44. Furthermore, there is no mutual conflict between the transport operations of supplying continuous paper 15 and retracting it from the printing section 24, and the transport operation of supplying single sheets 36 to the printing section 24, feeding and retracting continuous paper 15 and feeding single sheets 36, which can be smoothly effected.

Further features of the invention, its nature and various advantages will be apparent from the accompanying drawings and following detailed description of the invention.

DESCRIPTION OF THE PREFERRED EMBODIMENTS

Figure 1:
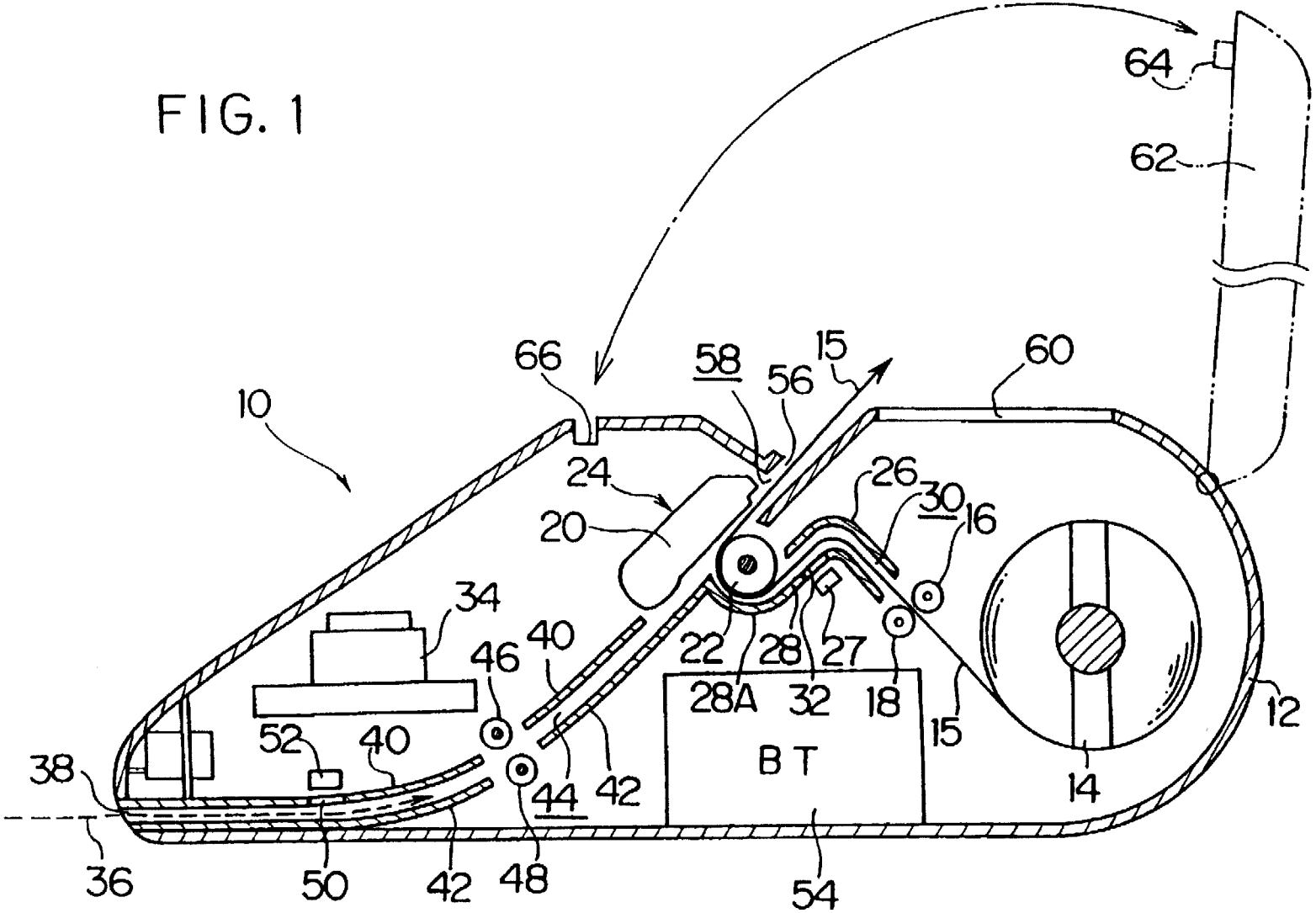
FIG. 1 is a sectional view illustrating an embodiment of the printer of the invention.
Figure 2:
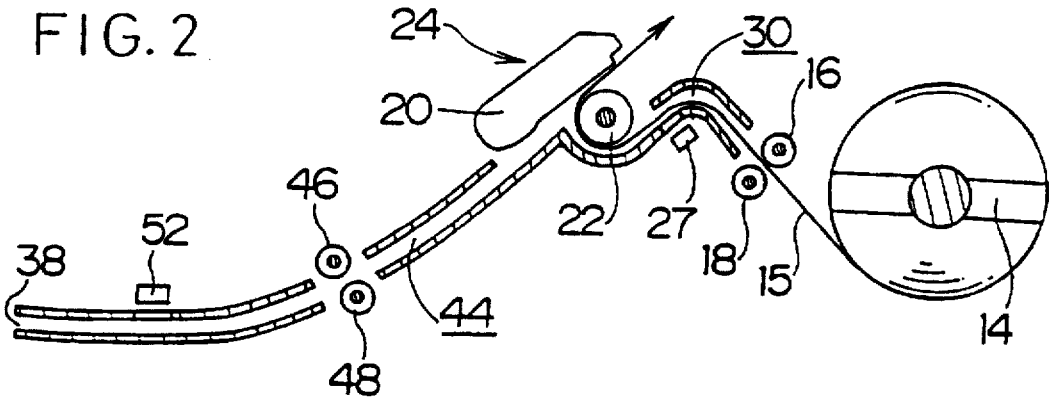
FIG. 2 shows the continuous paper arrangement immediately prior to printing of single sheets.

FIG. 1 is a sectional view of a first embodiment of a printer according to this invention, in this example a portable printer 10. As shown in FIG. 1, a paper supply reel 14 is rotatably provided at one end in an outer casing 12 of the portable printer 10. On the supply reel 14 is a roll of continuous paper 15. A first feed roller 16 and a first pinch roller 18 in contact with the first feed roller 16 are provided in the vicinity of the supply reel 14.

A printing section 24 comprising a print head 20 and a platen roller 22 is provided approximately in the center inside the casing 12. An upper plate 26 and a lower plate 28 form a continuous paper guide path 30 between the printing section 24 and the pair of rollers 16 and 18. A continuous paper sensor 27 faces an opening 32 about midway along the lower plate 28. The lower plate 28 has a curved portion **28*a* wherein the curvature is along the lower platen roller 22, facilitating insertion of the continuous paper 15 between the print head 20 and the platen roller 22. The platen roller 22 and the first feed roller 16 are linked with a reversible motor (not shown) that is activated to operate in either of the forward or reverse direction by a command from a controller 34. The continuous paper sensor 27 detects the presence or absence of the continuous paper 15 and outputs a detection signal to the controller 34**. The continuous paper guide path meets the printing section at a merge point where it merges with the below described single guide path.

An inlet 38 for insertion of single sheets 36 is formed in the casing 12, at the opposite end of the casing from the supply reel 14. A single sheet guide path 44 comprising an upper plate 40 and a lower plate 42 is provided between the inlet 38 and the printing section 24. The single sheet guide path meets the printing section at the merge point. There the continuous paper guide path and the single sheet guide path merge and both of those guide paths then extend through the printing section. The single sheet path 44 is divided or split part way along its length. A second feed roller 46 and a second pinch roller 48 that presses against the second feed roller 46 are provided in the division thus formed. The second feed roller 46 is rotated by a conventional motor (not shown) to feed a single sheet 36 to the printing section 24. A single sheet sensor 52 is provided facing an opening 50 formed in the upper plate 40 between the inlet 38 and the pair of rollers 46 and 48. The single sheet sensor 52 detects the presence or absence of single sheets 36 and outputs a detection signal to the controller 34.

In accordance with detection signals from the continuous paper sensor 27 and single sheet sensor 52, the controller 34 controls the printing operation of the printing section 24, reverse or forward rotation of the platen roller 22 and the first feed roller 16 and rotation of the second feed roller 46. The electrical power required for these operations is supplied from a battery 54 provided inside the casing 12.

An outlet 56 is formed above the printing section 24 in the upper surface of the casing 12 to allow the exit of either continuous paper 15 or single sheets 36 printed at the printing section 24. The upper surface of the casing 12 also has an opening 60 formed above the supply reel 14 via which a roll of continuous paper 15 can be loaded on the supply reel 14.

The portable printer 10 also has a cover 62 pivotally supported on the casing 12. When the portable printer 10 is not in use, the outlet 56 and opening 60 can be covered by closing the cover 62 with the insertion of a projecting piece 64 provided at the front edge portion of the cover 62 into a recess 66 arranged at a corresponding position to the projecting piece 64.

The method of printing both continuous paper 15 and single sheets 36 using the portable printer thus configured is now described, beginning with the printing of continuous paper 15.

The leading end of the roll of continuous paper 15 is manually drawn from the supply reel 14 and threaded between the first feed roller 16 and first pinch roller 18 and along the continuous paper path 30 until it reaches the continuous paper sensor 27. When the continuous paper sensor 27 detects the leading edge of the continuous paper 15, it outputs a detection signal to the controller 34. Based on this detection signal, the controller 34 rotates the platen roller 22 and first feed roller 16 by a prescribed amount in a direction in which the continuous paper 15 is fed to the printing section 24. The continuous paper 15 is thereby guided along the continuous paper path 30 to the printing section 24, and stops at the point at which the print head 20 commences printing. This completes the printing preparations. Print data is then input to the print head 20 by the controller 34 and printed on the continuous paper 15 by the print head 20. The continuous paper 15 thus printed is then transported between the print head 20 and platen roller 22 and fed out through the outlet 56. The first feed roller 16 may or may not be used to contribute to the transport of the continuous paper 15 while it is being printed. Continuous paper 15 emerging from the outlet 56 is cut at a suitable point by a cutter or the like (not shown). Alternatively, continuous paper 15 may be used that is provided with the perforations for dividing the paper.

Figure 3:
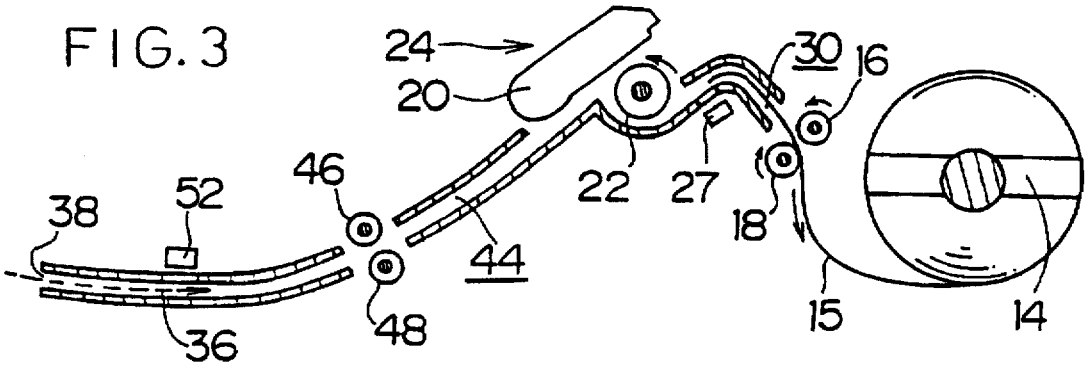
FIG. 3 shows the arrangement of the continuous paper at the time a single sheet is inserted via the inlet.
Figure 4:
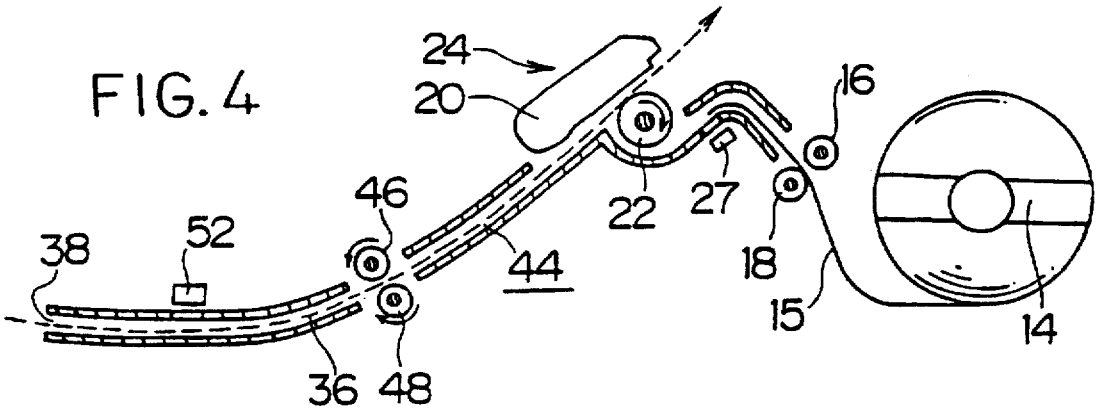
FIG. 4 shows the arrangement during printing of the single sheet.

The printing of a single sheet 36 is now described. At this time continuous paper 15 is located at the printing section 24. The process begins with a single sheet 36 being inserted into the single sheet path 44 via the inlet 38. Upon detecting the leading edge of the single sheet 36 the single sheet sensor 52 outputs a detection signal to the controller 34. Based on this signal, the controller 34 first rotates the platen roller 22 and first feed roller 16 by a prescribed amount to backfeed the continuous paper 15, thereby retracting continuous paper 15 until it is just behind the continuous paper sensor 27, as shown in FIG. 3, thus removing the continuous paper 15 from the printing section 24. The rotation of the first feed roller 16 rotates the first pinch roller 18 via the continuous paper 15. When the continuous paper sensor 27 no longer detects the presence of continuous paper 15, it outputs a signal to the controller 34, and the controller 34 stops the rotation of the platen roller 22 and first feed roller 16. The controller 34 then rotates the second feed roller 46 and the platen roller 22 by a prescribed amount to feed the single sheet 36 to the printing section 24. The rotation of the second feed roller 46 rotates the second pinch roller 48 via the single sheet 36. In this way, the single sheet 36, guided by the single sheet path 44, is fed to the printing section 24 and stopped at the point at which the print head 20 commences printing, as shown in FIG. 4, completing the printing preparations. As in the case of continuous paper 15, the print head 20 is operated by controller 34 to print the single sheet 36 in accordance with print data from the controller 34, and the printed single sheet 36 is fed out from outlet 56.

Thus, in accordance with the printer of this invention, when the printer is to print single sheet paper 36, continuous paper 15 is retracted to clear it from the printing section 24 before the single sheet 36 is fed to the printing section 24. The absence of continuous paper 15 at the printing section 24 facilitates the feeding of single sheets 36. In addition, transport of the single sheet 36 while it is being printed can be effected smoothly. Therefore the printer does not give rise to misaligned printing and other such problems that conventional printers are prone to. Moreover, as continuous paper 15 and single sheets 36 are fed to the printing section 24 along separate paths 30 and 44, there is no mutual conflict between the operations of supplying the continuous paper 15 and retracting it from the printing section 24, and the operation of supplying single sheets 36 to the printing section 24, transport of continuous paper 15 and single sheets 36 can be smoothly effected.

Also, retracting the continuous paper 15 from the printing section 24 to print single sheets 36 prevents the continuous paper 15 getting creased, ensuring that there will be no problems when the continuous paper 15 is printed.

Figure 5:
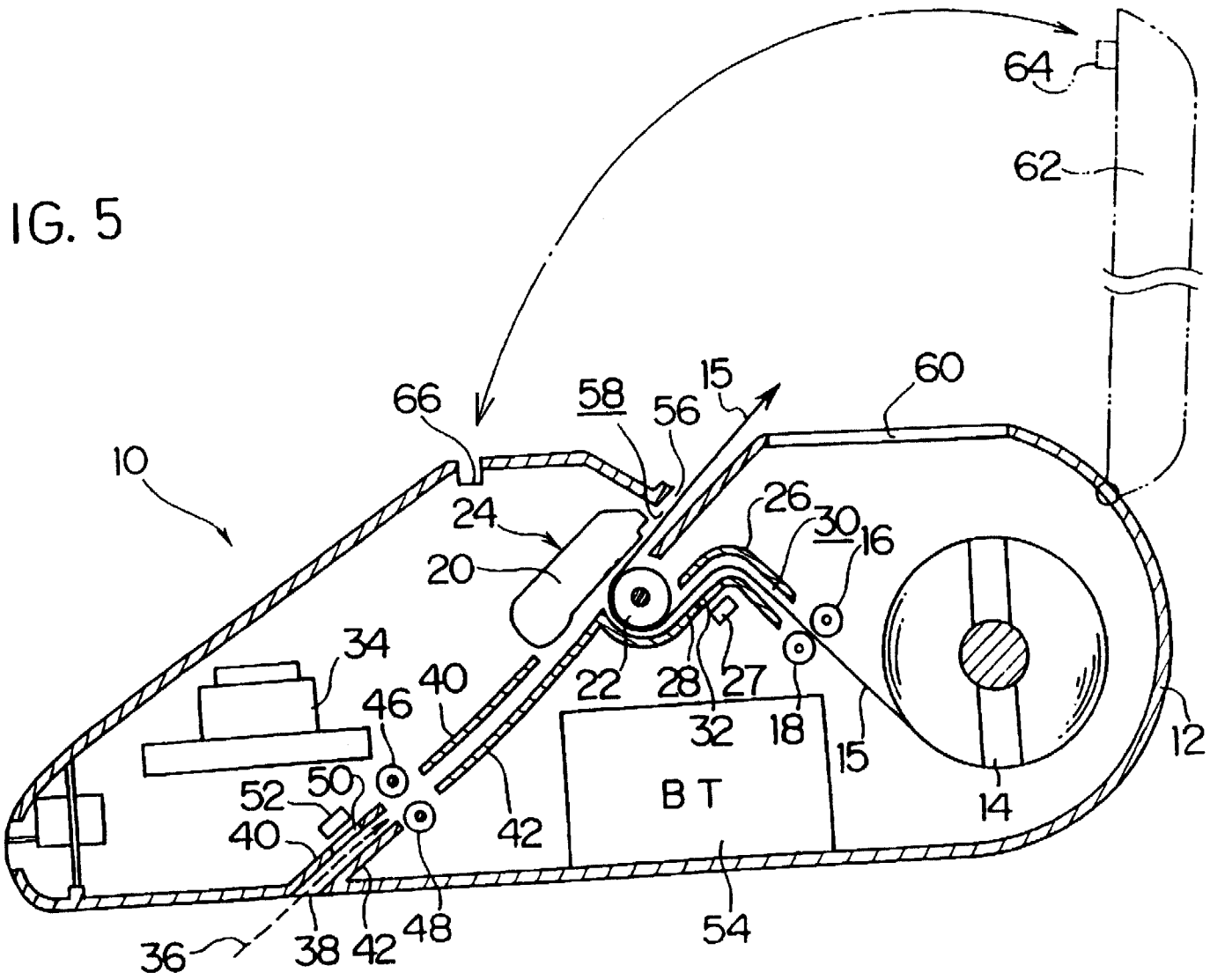
FIG. 5 is a sectional view illustrating another embodiment of the printer of the invention.

FIG. 5 shows another embodiment of the printer of the invention, in which the inlet 38 for inserting single sheets 36 is formed in the bottom surface of the casing 12. As shown in FIG. 5, the inlet 38 for inserting single sheets 36 is provided in the bottom part of the casing 12. A single sheet path 44 extends from the inlet 38 to the printing section 24, and a feed roller 46 and pinch roller 48 are provided to feed the single sheets 36 to the printing section 24. With this arrangement, attaching a shoulder strap to the casing 12 at the end where the supply reel 14 is located, for example, enables the printer to be conveniently used while slung from the shoulder.

Although the above description refers to a portable printer configuration for which the printer is supplied with electrical power from a battery provided inside the printer, an arrangement may be used in which electricity is supplied from a mains outlet.

As described in the foregoing, the printing method and printer of this invention comprises detecting beforehand that a single sheet is being fed to the printing section, and using this detection to remove continuous paper from the printing section before the arrival of the single sheet. This facilitates the feeding of single sheets to the printing section and therefore prevents faulty printing. Moreover, as continuous paper and single sheets are transported to the printing section along different paths, feeding and retraction of continuous paper and feeding of single sheets are both facilitated. Also, as the continuous paper does not become creased, it can be printed without problem.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of selectively printing either continuous paper or single sheet paper in a printer comprising supplying continuous paper to printing means in the printer in one direction along a first path through the printer; selectively feeding single sheet paper to the printing means within the printer along a second path different from the first path, wherein the first and second paths merge at a merge point shortly before either of the first and second paths extends to the printing means;

detecting when single sheet paper is being fed along the second path to the printing means, and based upon the detection of the single sheet paper being fed, retracting the continuous paper along the first path in a second direction away from the printing means before the single sheet paper is supplied to the printing means along the second path, wherein the detection is performed early enough along the second path and far enough before the merge point that when the single sheet paper reaches the merge point, the continuous paper has been retracted along the first path to before the merge point, whereby the continuous paper is away from the printing means and is not on the merged path with the single sheet paper when the single sheet paper is at the printing means for being printed.

2. The method of claim 1, further comprising selectively printing the continuous paper when the continuous paper is at the printing means and printing the single sheet paper when the single sheet paper is at the printing means without at the same time printing the continuous paper.

3. A printer for selectively printing continuous paper and single sheet paper, wherein the printer comprises:

a printing section including means for printing paper at the printing section;

first guide means in the printer shaped and positioned for defining a first guide path for guiding continuous paper through the printer and leading to the printing section;

second guide means in the printer shaped and positioned for defining a second guide path separate from the first guide path and also leading to the printing section for guiding single sheet paper through the printer to the printing section; the first and the second guide means being shaped so as to merge the first and the second guide paths at a merge point at the printing section before the printing means, wherein the merge point precedes the continuous paper or the single sheet paper being guided to the printing means;

first transport means at the first path operable selectively for feeding the continuous paper along the first path to the printing section or for retracting the continuous paper from the feeding section;

second transport means at the second guide path operable for transporting single sheet paper along the second path to the printing section;

detection means in the second path of the single sheet paper for detecting that single sheet paper is in the second path and is being transported by the second transport means to the printing section;

first control means connected with the detection means and with the first transport means so that when single sheet paper is detected in the second path, the first transport means is operated for retracting the continuous paper from the printing section and before the merge point, the detection means being located early enough along the second path and far enough before the merge point that when the single sheet paper reaches the merge point along the second path, the continuous paper has been retracted along the first path to before the merge point.

4. The printer of claim 3, further comprising second control means connected with the second transport means and with the detection means for operating the second transport means to move the single sheet to the printing section after the first transport means has retracted the continuous paper from the printing section.

5. The printer of claim 4, further comprising second detection means on the first path and before the merge point for detecting that the continuous paper has been retracted along the first path, out of the printing section and before the merge point, the second detection means being connected with the second transport means for operating the second transport means for transporting single sheet paper to the printing section after the second detection means has detected that the continuous paper has been retracted out of the printing section and before the merge point.

6. The printer of claim 4, wherein the first guide means defining the first guide path guides the continuous paper both toward and retracted from the printing section along the same first path.

7. The printer of claim 4, further comprising a supply of continuous paper in the printer.

8. The printer of claim 4, wherein there is a further path of paper through the printer past the printing section and the further path is a common path for both the continuous paper and the single sheet paper after each has been printed in the printing section.

* * * * *